US005525382A

United States Patent [19]

White

[11] Patent Number: 5,525,382

[45] Date of Patent: Jun. 11, 1996

[54] CHILE-PEPPER SHAPED ORNAMENT

[75] Inventor: Gayle Z. White, P.O. Box 1304, 102 Casas Lindas La., Santa Teresa, N.M. 88008

[73] Assignee: Gayle Z. White, Santa Teresa, N.M.

[21] Appl. No.: 382,861

[22] Filed: Feb. 3, 1995

[51] Int. Cl.[6] ..... A41G 1/00

[52] U.S. Cl. ..... 428/13; 428/17; 428/21

[58] Field of Search ..... D1/106; D9/307; D26/25, 32; 428/13, 21, 10, 17

[56] References Cited

U.S. PATENT DOCUMENTS

D. 282,649 2/1986 Crinklaw ..... 428/10 X 3,189,508 6/1965 Burnbaum ..... 428/21

4,737,129 4/1988 Gorley et al. ..... 428/21 X 4,795,033 1/1989 Duffy ..... D9/307 X

*Primary Examiner*—Henry F. Epstein

*Attorney, Agent, or Firm*—Hill, Steadman & Simpson

[57] ABSTRACT

A decorative ornament is provided in the shape of a chile pepper. The ornament has a pair of exterior shells each forming a longitudinal half of the chile pepper. Peripheral edges of the halves of the ornament are matable to selectively open and close the ornament. Within the interior of the closed ornament is foliage. The walls of the ornament are transparent such that the foliage is readily observable from the exterior of the ornament when enclosed therein.

13 Claims, 1 Drawing Sheet

CHILE-PEPPER SHAPED ORNAMENT

BACKGROUND OF THE INVENTION

The present invention generally relates to an ornament. More specifically, the invention relates to an ornament of a unique design capable of loosely carrying articles, such as foliage, therein. The ornament is separable such that the foliage from within the ornament may be removed and the separate halves of the ornament may be used individually as desired.

It is, of course, generally known to provide ornaments for hanging on a tree, for example, during special occasions or holidays during a calendar year. One such notable year is Christmas during which individuals, families and the like erect artificial or live trees on which ornaments are placed to decorate the same.

Such ornaments are typically integrally formed and little or no use of the ornament is available outside of the Christmas holiday. The ornaments, however, are generally boxed, saved and re-used from year to year.

In addition, most ornaments have little or no meaning outside of the ordinary appearance of the ornament. For example, figurines in the shape of animals, angels, stars, and the like are often placed on trees when being decorated. However, the figurines have no special meaning in most instances beyond what the figurine actually represents.

SUMMARY OF THE INVENTION

The present invention provides an ornament having an exterior shell that is chile-pepper shaped. The ornament is separable to remove an article, such as foliage, contained therein wherein the separate parts of the ornament may be independently used as desired.

To this end, in an embodiment, the present invention provides a chile-pepper shaped ornament for hanging. The ornament comprises a first concave shell having a first half of a mating ridge around a periphery of the first shell and a second concave shell having a second half of a mating ridge around a periphery of the second shell wherein the concave shells mate to form an enclosed shell having an interior wherein the enclosed shell is in the shape of a chile pepper.

In an embodiment, the chile-pepper shaped ornament further comprises stem portions integrally formed with each of the concave shells in an aperture formed through each stem portion wherein the apertures are aligned when the shells are mated.

In an embodiment, the chile-pepper shaped ornament of the present invention further comprises foliage loosely maintained within the interior of the enclosed shell. The foliage may be artificial, may include at least one chile, and/or may further include mistletoe.

In an embodiment, the chile-pepper shaped ornament of the present invention is selectively openable after mating the shells to form the enclosed shell.

In an embodiment, the shells are plastic and/or transparent.

In another embodiment of the present invention, a transparent chile-pepper shaped ornament is provided having a first rigid wall forming a first concave shell resembling one longitudinal half of a chile pepper and a second rigid wall forming a second concave shell resembling an opposite longitudinal half of a chile pepper. Means for selectively mating the first rigid wall with the second rigid wall to form a hollow interior from the first concave shell and the second concave shell is provided. Foliage is insertable into the hollow interior prior to mating the first rigid wall with the second rigid wall.

In an embodiment, an aperture is provided in each of the rigid walls of the present invention wherein the apertures are aligned during mating of the rigid walls.

In an embodiment, the means for selectively mating include peripheral edges on each of the rigid walls constructed and arranged for a snap fit engagement of the rigid walls.

It is, therefore, an advantage of the present invention to provide an ornament that is capable of holding articles when used as an ornament.

Another advantage of the present invention is to provide an ornament that is separable for removing articles contained therein and for subsequent use of the separated parts of the ornament.

Yet another advantage of the present invention is to provide an ornament having meaning beyond the normal representation of the ornament.

Moreover, an advantage of the present invention is to provide an ornament that is lightweight and transparent.

A still further advantage is to provide an ornament that may be easily assembled and dis-assembled.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention provides an ornament capable of carrying an article in its ornamental position such that the article can be seen through exterior walls of the ornament. In addition, the ornament is separable such that the articles can be removed and the ornament may be subsequently used for other purposes.

Figure 1:
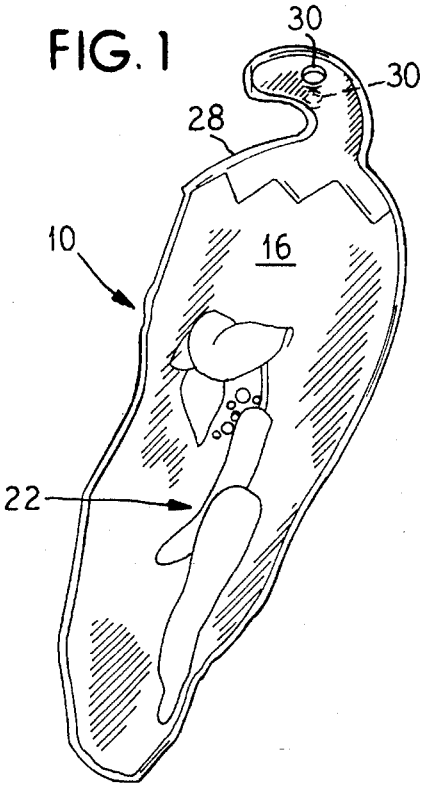
FIG. 1 illustrates a perspective view of an embodiment of a chile-pepper shaped ornament of the present invention.
Figure 2:
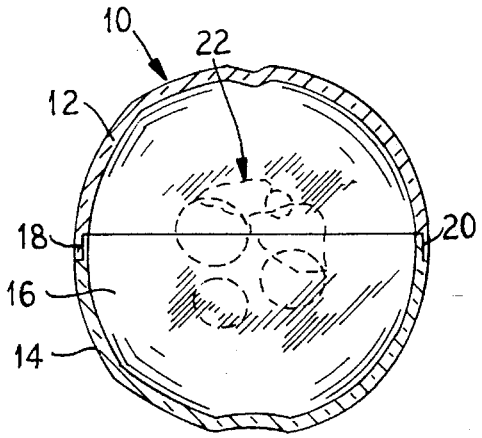
FIG. 2 illustrates a cross-sectional view of the chile-pepper shaped ornament taken generally along a line II—II of FIG. 1.

Referring now to the drawings wherein like numerals refer to like parts, a chile-pepper shaped ornament 10 is generally illustrated. The ornament 10 has a contoured exterior so as to resemble a chile pepper, such as a common hot pepper. The ornament 10 consists of two concave shells 12, 14. The shells 12,14 are preferably molded from plastic and are at least partially transparent. Of course, other materials may be implemented in order to form the exterior walls of the ornament 10 when the two concave shells 12,14 mate as illustrated in FIG. 2 so as to form a hollow interior 16 of the ornament 10. To this end, the first concave shell 12 has a peripheral edge 18 overlapping a detented peripheral edge 20 of the second concave shell 14. As a result, the second concave shell 14 nests with the first concave shell 12 to form the interior 16 of the ornament 10.

The interior 16 may include foliage 22 therein. In a preferred embodiment, the foliage 22 is artificial. In a still further embodiment, the foliage 22 includes artificial mistletoe 24 and dried red chile peppers 26. The chile peppers 24 and mistletoe 26 may be pulled or tied together to form a bouquet. Since the walls of the shell 12,14 of the ornament are preferably transparent, the foliage 22 is clearly seen from outside of the enclosed ornament 10.

In a preferred embodiment of the present invention, a card (not shown) is provided with the ornament 10. The card explains the relationship of the chiles 24 and the mistletoe 26 within the ornament 10 as an individual would not generally associate the combination or otherwise understand the relation of the chile peppers 24 to the mistletoe 26.

The shells 12, 14 of the ornament 10 each include an integrally molded stem section 28. The stem sections 28 each include an aperture 30 which, when the shells 12, 14 are mated, are aligned immediately across from one another. A thread or like string (not shown) may be threaded through the apertures 30 such that the ornament 10 may be ornamentally suspended from the string so as to hang from, for example, a tree.

Figure 3:
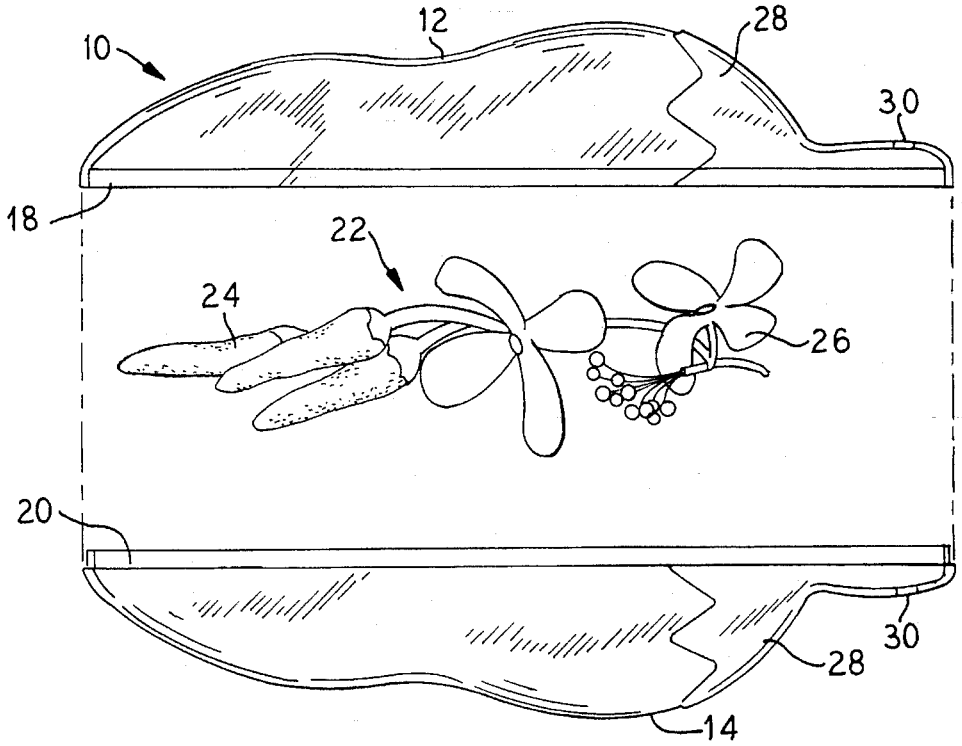
FIG. 3 illustrates an exploded plan view of an embodiment of the ornament of the present invention.

Referring now to FIG. 3, an exploded view of the two concave shells 12, 14 with the foliage 22 consisting of the mistletoe 24 and the chile peppers 26 is illustrated. The foliage 22 may be selectively removed from the interior 16 of the ornament 10 for separate usage of each of the concave shells 12, 14. For example, the shells 12, 14 may be used for individual storage compartments or serving bowls during times when the ornament 10 is not generally used.

The peripheral edge 18 of the first concave shell 12 and the detented peripheral edge 20 of the second concave shell 14 allow for a snap fit engagement of the shells 12, 14 to form the ornament 10. As desired, new foliage 22 may be added to the interior 16, removed from the interior 16, or replaced within the interior 16 of the ornament 10. The nesting capability of the shells 12, 14 of the ornament 10 allow for quick and simple removal of the contents of the interior 16 of the ornament 10.

Furthermore, the foliage 22 inserted within the interior 16 of the ornament 10 is maintained within the ornament due to the shape of the ornament 10. That is, since the ornament tapers from the portions beneath the stem sections 28 to an opposite tip, the foliage 22 may be supported by an interior wall of the ornament 10 or supported at the base of the ornament 10. Nonetheless, in a preferred embodiment, the foliage 22 is rigid so as to stand and fill a length of the interior 16 of the ornament 10.

Of course, the ornament 10 may be secured in other known fashions such that the ornament 10 may be selectively opened and closed. For example, the ornament 10 may include a hinge (not shown) along a seam between the two shell walls 12, 14 of the ornament 10 such that the ornament 10 may be opened and closed at the hinge. Further, the ornament 10 may be sealed such that the ornament 10 is not openable following insertion of the foliage 22 into the interior 16 of the ornament 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A chile-paper shaped ornament for hanging, the ornament comprising:

a first concave shell having a first half of a mating ridge around a periphery of the first shell;

a second concave shell around a periphery of the second shell having a second half of a mating ridge wherein the concave shells mate to form an enclosed shell having an interior wherein the enclosed shell is in the shape of a chile pepper;

a stem portion integrally formed with each of the concave shells; and an aperture formed through each stem portion wherein the apertures are aligned when the shells are mated.

2. The chile-pepper shaped ornament of claim 1 further comprising:

foliage loosely maintained within the interior of the enclosed shell.

3. The chile-pepper shaped ornament of claim 2 wherein the foliage is artificial.

4. The chile-pepper shaped ornament of claim 2 wherein the foliage includes at least one chile.

5. The chile-pepper shaped ornament of claim 2 wherein the foliage includes mistletoe.

6. The chile-pepper shaped ornament of claim 1 wherein, after mating to form the enclosed shell, the first concave shell and the second concave shell are selectively openable.

7. The chile-pepper shaped ornament of claim 1 wherein the shells are plastic.

8. The chile-pepper shaped ornament of claim 1 wherein the shells are transparent.

9. A transparent chile-pepper shaped ornament comprising:

a first rigid wall forming a first concave shell resembling a longitudinal half of a chile pepper;

a second rigid wall forming a second concave shell resembling an opposite longitudinal half of a chile pepper;

means for selectively mating the first rigid wall with the second rigid wall to form a hollow interior from the first concave shell and the second concave shell;

foliage insertable into the hollow interior prior to mating the first rigid wall with the second rigid wall; and an aperture in each of the rigid walls wherein the apertures are aligned during mating of the rigid walls.

10. The ornament of claim 9 wherein the foliage is artificial.

11. The ornament of claim 9 wherein the foliage is a combination of mistletoe and chile peppers.

12. The ornament of claim 9 wherein the rigid walls are formed from plastic.

13. The ornament of claim 9 wherein the means for selectively mating includes peripheral edges on each of the rigid walls constructed and arranged for a snap fit engagement of the rigid walls.

* * * * *